US005239749A

United States Patent [19]

Fujimaki et al.

[11] Patent Number: 5,239,749

[45] Date of Patent: Aug. 31, 1993

[54] PRESS-CONNECTING CONSTRUCTION FOR CONSTRUCTION CABLE AND PRESS-CONNECTING METHOD

[75] Inventors: Hirohiko Fujimaki; Kazuhito Sano, both of Shizuoka, Japan

[73] Assignee: Yazaki Corporation, Tokyo, Japan

[21] Appl. No.: 954,400

[22] Filed: Sep. 30, 1992

Related U.S. Application Data

[63] Continuation of Ser. No. 703,532, May 21, 1991, abandoned.

[30] Foreign Application Priority Data

May 25, 1990 [JP] Japan ..... 2-134057

[51] Int. Cl.[5] ..... H01R 43/04

[52] U.S. Cl. ..... 29/877; 29/863; 174/84 C; 439/203; 439/519; 439/875

[58] Field of Search ..... 439/203, 519, 275, 792, 439/793, 865, 875, 877, 880; 29/863, 868, 872, 877; 174/84 C, 90, 94 R, 128.1

[56] References Cited

U.S. PATENT DOCUMENTS

| | | | |
|---|---|---|---|
| 3,111,554 | 11/1963 | Harris | 174/84 C |
| 3,243,758 | 3/1966 | Frant et al. | 439/519 |
| 3,980,806 | 9/1976 | May | 174/84 C |
| 4,969,260 | 11/1990 | Kondo et al. | 29/877 |

FOREIGN PATENT DOCUMENTS

| | | |
|---|---|---|
| 789524 | 1/1958 | United Kingdom . |
| 793876 | 4/1958 | United Kingdom . |
| 905849 | 9/1962 | United Kingdom . |
| 913693 | 12/1962 | United Kingdom . |
| 1004208 | 9/1965 | United Kingdom . |

*Primary Examiner*—Paula A. Bradley

*Attorney, Agent, or Firm*—Sughrue, Mion, Zinn, Macpeak & Seas

[57] ABSTRACT

A method and apparatus for interconnecting cables to improve electrical characteristics of the connected cables. The apparatus comprises a terminal having clamping pieces integrally formed respectively on opposite sides of a base portion of the terminal. The conductor wires of the cables are arranged in layers on the base portion, and the clamping pieces are press-clamped in the direction in which the conductor wires are layered. The method comprises the steps of placing conductor wires of one cable on a base portion of a terminal having clamping pieces integrally formed respectively on opposite sides of said base portion; compressing the conductor wires so as to form a surface of the conductor wires into a flattened configuration; placing conductor wires of another cable on the surface in a layered manner; and press-clamping the clamping pieces in the direction in which the conductor wires of the two cables as layered one upon the other.

4 Claims, 4 Drawing Sheets

PRESS-CONNECTING CONSTRUCTION FOR CONSTRUCTION CABLE AND PRESS-CONNECTING METHOD

This is a continuation of application Ser. No. 07/703,532 filed May 21, 1991, now abandoned.

BACKGROUND OF THE INVENTION

1. Field of the Invention

This invention relates to a method and apparatus for connecting cables to one another in order to provide improved electrical characteristics of the connected cables.

2. Background

FIG. 1 is a plan view of a conventional arrangement for connecting cables to one another using a joint terminal, and FIG. 2 is a cross-sectional view taken along the line B—B of FIG. 1.

The joint terminal 28 has a pair of opposed clamping pieces 30 and 30 integrally formed respectively on opposite sides of a base plate portion 29. Conductor wires 33 and 34 of two covered or sheathed cables 31 and 32 are placed in parallel on the base plate 29, and the clamping pieces 30 and 30 are press-clamped relative to the conductor wires 33 and 34 by a clamping tool (not shown). The conductor wires 33 and 34 are juxtaposed on the right and left side of the base plate 29, and are in contact with each other at the central portion b (indicated by a dot-and-dash line in FIG. 2) and also through the base plate 29.

However, in the above conventional construction, the direction in which the wires are pressed (indicated by arrows c in FIG. 2) when the clamping pieces 30 and 30 are deformed is perpendicular to the direction (indicated by arrows d) of contact between the conductor wires 33 and 34. Therefore, the contact force between the conductor wires 33 and 34 is weak resulting in a corresponding small contact area and poor connection. Therefore, the electric resistance at the contact portion b is increased. Further, the connecting strength withstanding the pulling of the cables 31 and 32 in directions e-e in FIG. 1 is weak.

In view of the above problems, it is an object of this invention to provide an apparatus and a method which improve the electrical contact resistance and connecting strength of the connected cables.

SUMMARY OF THE INVENTION

The above object has been achieved by an apparatus for connecting cables, comprising a terminal having clamping pieces integrally formed respectively on opposite sides of a base portion of the terminal wherein the conductor wires of the cables are arranged in layers on the base portion, and the clamping pieces are press-clamped in the direction in which the conductor wires are layered. The above object also has been achieved by a press-connecting method comprising the steps of placing conductor wires of one cable on a base portion of a terminal having clamping pieces integrally formed respectively on opposite sides of said base portion; compressing the conductor wires so as to form a surface of the conductor wires into a flattened configuration; placing conductor wires of another cable on the surface in a layered manner; and press-clamping the clamping pieces in the direction in which the conductor wires of the two cables as layered one upon the other.

Since the conductor wires of the cables are arranged in layers on the base plate portion, the area of contact between the conductor wires and the degree of intimate contact therebetween are increased. Further, since the clamping pieces are press-clamped in the direction in which the conductor wires are layered, the strength of connection between the conductor wires is increased. Therefore the electric characteristics and the mechanical characteristics are improved.

DETAILED DESCRIPTION OF THE PREFERRED EMBODIMENT

Figure 1:
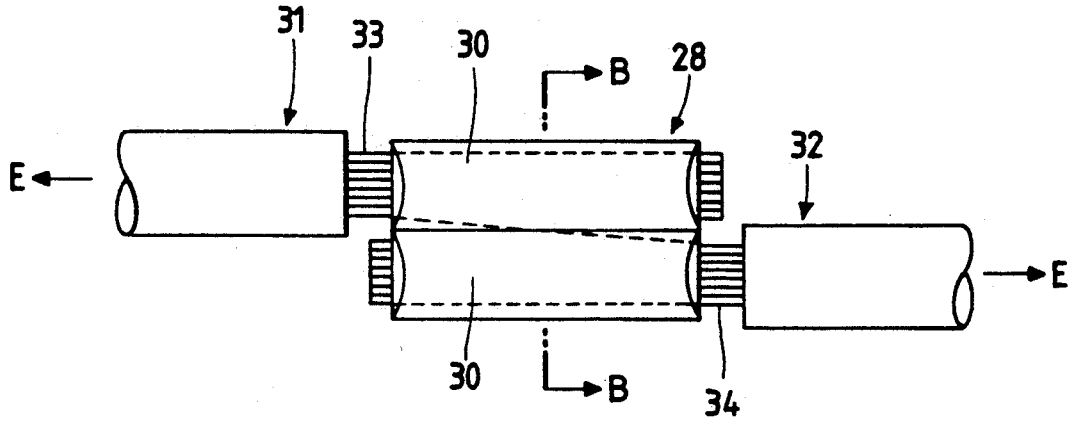
FIG. 1 PRIOR ART
FIG. 1 is a plan view of a conventional clamping arrangement.
Figure 2:
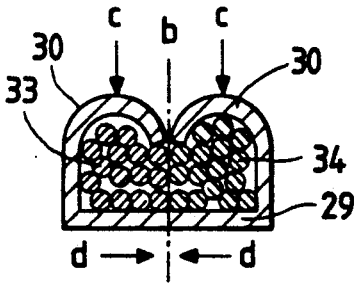
FIG. 2 PRIOR ART
FIG. 2 is a cross-sectional view taken along the line B—B of FIG. 1.
Figure 3:
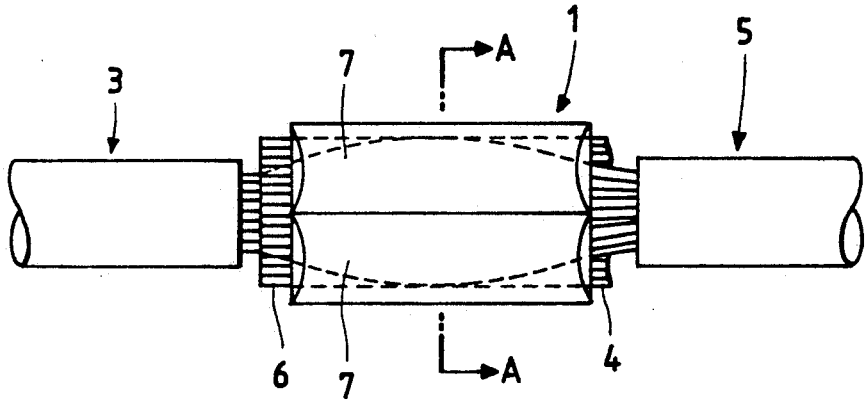
FIG. 3 is a plan view of one preferred embodiment of a press-connecting construction of the present invention.
Figure 4:
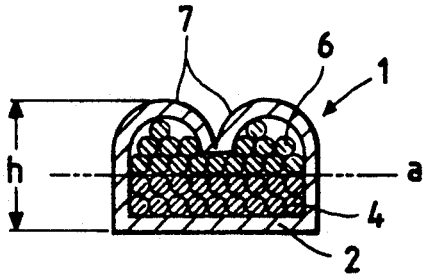
FIG. 4 is a cross-sectional view taken along the line A—A of FIG. 3.

FIG. 3 is a plan view of a press-connecting construction for connecting cables, provided in accordance with the present invention, and FIG. 4 is a cross-sectional view taken along the line A—A of FIG. 3. Referring thereto, conductor wires 4 of a first covered cable 3 are spread in a flattened manner over a base plate portion 2 of a joint terminal 1 (which is similar to a conventional terminal), and conductor wires 6 of a second covered cable 5 are similarly spread in a flattened manner over the conductor wires 4 of the first cable. Namely, the conductor wires 4 and 6 are stacked or superposed in two layers (upper and lower layers) on the base plate portion 2. Thereafter, clamping pieces 7 and 7 of the joint terminal 1 are deformed in the direction in which the conductor wires 4 and 6 are layered on one another. With this arrangement, the conductor wires 4 and 6 are in intimate contact with each other at a generally central portion, indicated by a dot-and-dash line a, of the height h.

Figure 5:
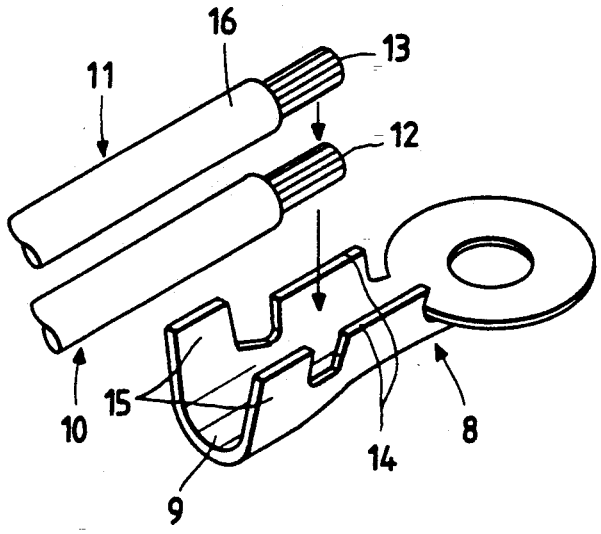
FIG. 5 is a perspective view showing a modified form of the invention.

It is possible to interconnect more than two cables to one another by arranging respective conductor wires one upon the other in a multi-layered manner. In this case, instead of utilizing joint terminal 1, a press-connecting terminal 8 as shown in FIG. 5 may be used. Referring thereto, conductor wires 12 and 13 are arranged in layers upon base plate portion 9, and clamping pieces are press-clamped, as in the above example. A clamping piece 15 is designed to clamp a sheath portion 16 of the cable to fixedly secure the terminal to the cable. While FIG. 5 only shows two cables, it is understood that additional cables could be layered on top of the two illustrated cables, as discussed above.

FIGS. 6(*a*) to 6(*e*) are vertical cross-sectional views showing the sequence of a press-connecting method according to the present invention. More specifically, first, a terminal 18 is placed on an anvil 17, and first conductor wires 20 are placed on a base plate portion 19 of the terminal (FIG. 6(*a*). Then, the conductor wires 20 are compressed into a spread, flattened configuration by a pressing member 22 having a rectangular pressing flat surface 21, thereby forming a flat surface 23 (FIG. 6(*b*)), the pressing member 22 being connected to a pressing machine (not shown). Thereafter, the second conductor wires 24 are placed on the flat surface 23 (FIG. 6(*c*)), and a compressive force is applied to the conductor wires 24 by the pressing member 22 (FIG. 6(*d*)). Finally, clamping pieces 27 and 27 are inwardly curled by a crimper 26, having a pair of grooves 25, to apply a press-clamping force in the direction in which the conductor wires 20 and 24 are layered thus completing the press-connecting operation. The compressing step in FIG. 6(*d*) may be omitted, in which case the compression would be carried out at the press-clamping step in FIG. 6(*e*). Also, the conductor wires 20 and 24 may be manually stacked without using the pressing member 22 such that the steps in illustrated in FIGS. 6(*b*) and 6(*d*) may be omitted, and the press-connecting may be carried out directly during the press-clamping step in FIG. 6(*e*). In this case, considerable effects can be achieved.

As described above, the conductor wire 20 and 24 of the cables are stacked in layers on the base plate portion 19, and the clamping pieces 27 are press-clamped in the direction in which the conductor wires are stacked. Therefore, the contact area and force between the conductor wires 20 and 24 is increased, the contact resistance is reduced and the connecting strength is increased.

Figure 7:
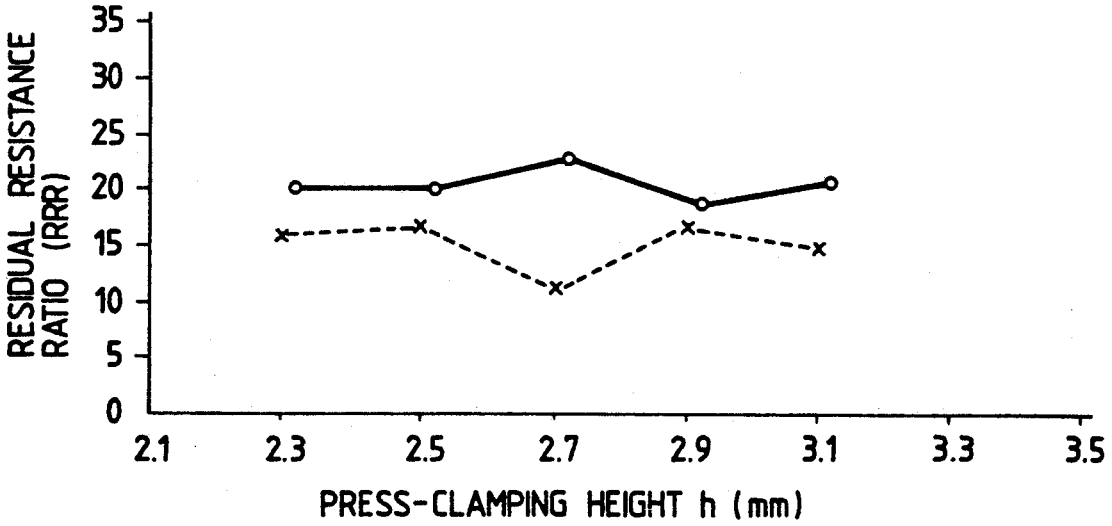
FIGS. 7 and 8 are graphs showing advantageous effects of the clamping arrangement of the present invention.
Figure 6A:
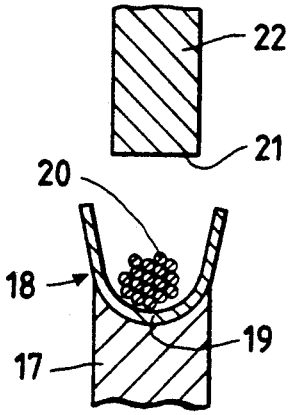
FIGS. 6(*a*) to 6(*e*) are vertical cross-sectional views showing one preferred embodiment of a press-connecting method of the present invention.
Figure 6B:
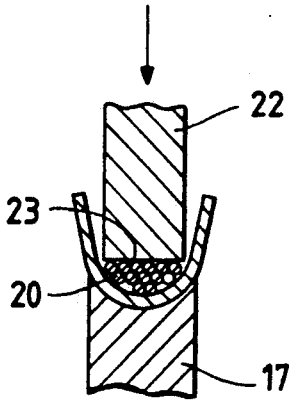
Figure 6C:
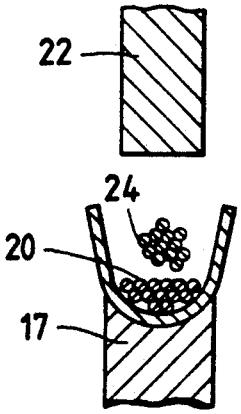
Figure 6D:
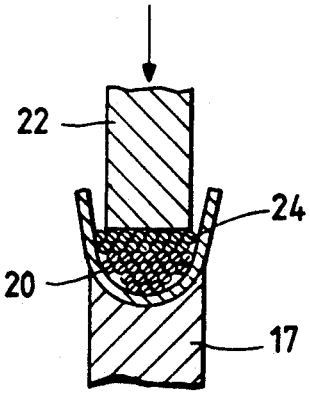
Figure 6E:
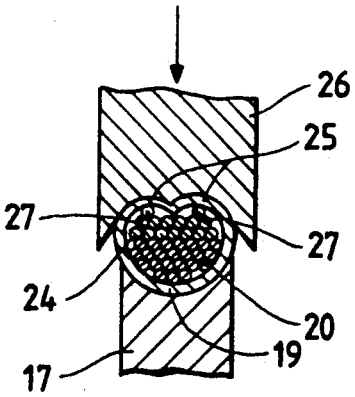
Figure 8:
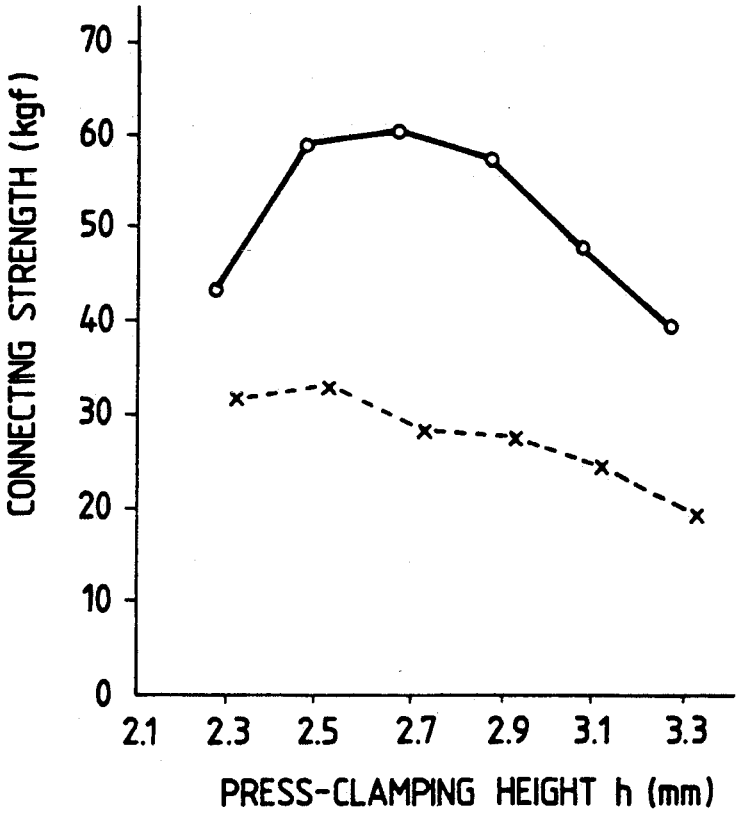

FIG. 7 shows comparative data representative of electric characteristics (residual resistance ratio) of the present invention and a conventional construction, and FIG. 8 shows data representative of mechanical characteristics (connecting strength) thereof, where the solid line indicates the present invention, and the broken line indicates the conventional construction. As can be seen in FIG. 7, the present invention exhibits excellent electrical contact and connecting strength, as compared to the conventional connector. In these Figures, the abscissa axis represents the height h of press-clamping, as references in FIG. 4.

As described above, in the present invention, the electric characteristics of the connected cables are improved, and the contact resistance reduced. At the same time, the strength of connection between the cables is increased, so that withdrawal of the cable resulting from an accidental pulling thereof can be prevented.

Figure 9:
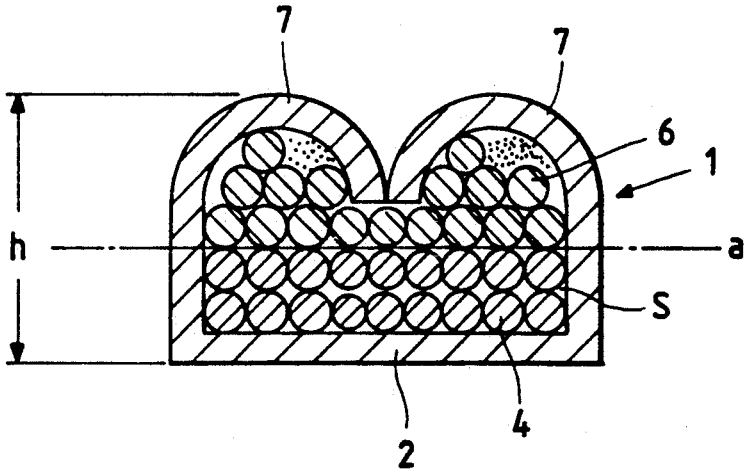
FIG. 9 is a cross-sectional view showing additional embodiments of the press-connecting arrangement of the present invention.

FIG. 9 illustrates and additional embodiment of the present invention. For the purpose of simplicity, like elements are identified with the same reference numerals as used in the previously described embodiments. As shown in FIG. 9, according to a second embodiment of the invention, an organic sealing material S having a thermal deformation temperature not less than 100° C. is applied on the wires 4 and 6 and the clamping pieces 7 and 7. Thereafter, the clamp pieces are deformed so as to clamp the wires and cables, as described above. By applying the sealing material to the wires and thereafter clamping the clamping pieces, the sealing material completely fills the gaps between the wires, as illustrated in FIG. 9. As a result, the following effects can be obtained. Firstly, the area of contact between the two sets of wires is increased providing a more stable electrical connection. Further, oxidation of the surface of the cable is prevented since the surface is not exposed to air and capillary action of moisture is thereby prevented. Additionally, the tensile strength between the cables can be increased by the bonding effect of the sealing material. Finally, electrical and mechanical strength are very high so that it is not necessary to limit the number of cables.

According to another embodiment of the invention, the sealing material consists of a metal powder dispersed within an organic resin having a thermal deformation temperature not less than 100° C. The sealing material is applied on the wires 4 and 6 and the clamping pieces 7, and thereafter, the cables are press-clamped by the clamp piece, providing the same advantages as described above in regard to FIG. 9.

What is claimed is:

1. A method of securing conductor wires of a plurality of cables to one another, comprising the following steps:

placing a first set of conductor wires of a first cable on a base portion of a terminal having individual clamping pieces integrally formed respectively on opposite sides of said base portion and extending therefrom;

arranging said first set of conductor wires so as to form surface of said conductor wires in a flattened configuration along said base portions;

placing a second set of conductor wires of a second cable on said surface so as to stack said first and second sets of wires in a stacking direction;

press-clamping said clamping pieces in said stacking direction; and compressing said first set of conductor wires after said arranging step and before said press-clamping step.

2. The method of claim 1, further comprising the step of providing a sealing material between said wires having a thermal deformation temperature not less than 100° C.

3. The method of claim 1, further comprising the step of providing a sealing material between said wires, said sealing material consisting of a metal powder dispersed within an organic resin having a thermal deformation temperature not less than 100° C.

4. A method of securing conductor wires of a plurality of cables to one another, comprising the following steps:

placing a first set of conductor wires of a first cable on a base portion of a terminal having clamping pieces integrally formed respectively on opposite sides of said base portion and extending therefrom;

arranging said first set of conductor wires so as to form a surface of said conductor wires in a flattened configuration along said base portions;

placing a second set of conductor wires of a second cable on said surface so as to stack said first and second sets of wires in a stacking direction;

press-clamping pieces in said stacking direction; and compressing said first and second sets of conductor wires said placing step and before said press-clamping step.

* * * * *